US007037405B2

(12) United States Patent
Nguyen et al.

(10) Patent No.: US 7,037,405 B2
(45) Date of Patent: May 2, 2006

(54) SURFACE TREATMENT WITH TEXTURIZED MICROCRYSTALLINE CELLULOSE MICROFIBRILS FOR IMPROVED PAPER AND PAPER BOARD

(75) Inventors: Xuan Truong Nguyen, Cincinnati, OH (US); Zheng Tan, Mason, OH (US)

(73) Assignee: International Paper Company, Stamford, CT (US)

( * ) Notice: Subject to any disclaimer, the term of this patent is extended or adjusted under 35 U.S.C. 154(b) by 40 days.

(21) Appl. No.: 10/437,849

(22) Filed: May 14, 2003

(65) Prior Publication Data

US 2004/0226671 A1 Nov. 18, 2004

(51) Int. Cl.
*D21H 19/34* (2006.01)
*D21C 3/04* (2006.01)
*D21B 1/16* (2006.01)

(52) U.S. Cl. ..... 162/25; 162/135; 162/136; 162/157.7; 162/186; 162/76

(58) Field of Classification Search ..... 162/9, 162/60, 76, 90, 124, 136, 25, 26, 137, 157.1, 162/146, 135, 183–186, 205, 206; 536/56, 536/128
See application file for complete search history.

(56) References Cited

U.S. PATENT DOCUMENTS 2,978,446 A * 4/1961 Battista et al. ..... 536/56
4,427,778 A 1/1984 Zabriskie
4,483,743 A * 11/1984 Turbak et al. ..... 162/100
5,123,962 A 6/1992 Komuro et al.
5,543,511 A 8/1996 Bergfeld et al.
5,637,197 A 6/1997 Watt et al.
6,214,163 B1 4/2001 Matsuda et al.
6,228,213 B1 5/2001 Hanna et al.
2002/0139498 A1* 10/2002 Matheson et al. ..... 162/76
2002/0142032 A1* 10/2002 Sherwood et al. ..... 424/465

FOREIGN PATENT DOCUMENTS

| | | |
|---|---|---|
| CA | 851006 | 9/1970 |
| CA | 2060105 | 7/1992 |
| JP | K190955/82 | 11/1982 |
| JP | K118293/86 | 6/1996 |
| RU | 569679 | 8/1977 |
| WO | WO 95/22571 * | 8/1995 |

OTHER PUBLICATIONS

D.C. Johnson, A.R. Winslow, "Bacterial Cellulose ", Pulp & Paper, May 1990, pp. 105-107.
M. Foulger, J. Parisian, "Cost Effective New Technology", TAPPI 1999 Proceedings, p. 141.
F. Miskiel, "Utilizing Cellulon Cellulosic Fiber", 1997 TAPPI Nonwoven Conference, pp. 101-104.

* cited by examiner

*Primary Examiner*—Eric Hug
(74) *Attorney, Agent, or Firm*—Matthew M. Eslami

(57) ABSTRACT

The present invention relates to the production of texturized microcrystalline cellulose from raw pulp material. This texturized microcrystalline cellulose can then be used for surface treatment of paper or paper board. Additionally, the texturized microcrystalline cellulose may be used as a starting material for production of paper or paper board.

23 Claims, 5 Drawing Sheets

TRANSFORMATION OF HIGH ALPHA CELLULOSE PULP INTO MCC

FIG. I

SURFACE TREATMENT WITH TEXTURIZED MICROCRYSTALLINE CELLULOSE MICROFIBRILS FOR IMPROVED PAPER AND PAPER BOARD

FIELD OF THE INVENTION

The present invention relates to the field of paper production. More particularly, it relates to production of texturized microcrystalline cellulose from raw pulp material. This texturized microcrystalline cellulose can then be used for surface treatment of paper or paper board. Additionally, the texturized microcrystalline cellulose may be used as a starting material for production of paper or paper board.

BACKGROUND OF THE INVENTION

There exists a need for a low cost method to enhance the quality of paper and paper board made from southern pine or fiber from other softwood species. The over use of hardwood in the production of paper products, especially in this country, has reduced the quantity of available hardwoods and consequently driven up the price of these woods as raw materials. Therefore, not only is the need for a process that employs softwoods, instead of hardwoods, economically driven, it is also environmentally driven. The problem with paper product produced from softwood is that it yields a rough finished product with low quality surface features.

The prior art, particularly, Canadian Patent No. 2,060,105 teaches the use of microcrystalline cellulose (hereinafter "MCC") addition to paper products. The MCC used in the prior art processes, however, is of the commercial high grade variety. Commercial MCC is generally defined as having a 97% cellulose content (US Pharmacopoeia USP 23 NF 18). This high degree of cellulose concentration is achieved through various techniques known in the art such as hydrolysis, enzymatic action, pressurization, reactive extrusion and combinations of the above. See U.S. Pat. Nos. 2,978,446; 6,228,213; 5,543,511 and 4,427,778. All of these processes, however, render the final paper product uneconomical. Moreover, none of these patents teach the hydrolysis of a low grade pulp to produce texturized microcrystalline cellulose with a cellulose content of 90% to be used for surface treatment of paper and paper board. Additionally, many of these techniques require processing equipment that is not traditionally employed at paper production facilities, especially the processes that require enzymatic action.

MCC has traditionally been difficult to develop in a cost effective manner for usefulness in surface treatment of paper. The market value of MCC powder is known to range from $5,000 to $10,000 per ton. CELLULON®, manufactured by Weyerhaeuser, for use as a surface treatment for paper, is a biologically produced cellulose microfibril material that costs roughly $6 to $10 per pound, thereby rendering it prohibitively expensive (see D. C. Johnson, A. R. Winslow, "Bacterial cellulose has potential application as new paper coating", Pulp & Paper, May 1990, page 105–107). Therefore, the need exists for a low cost MCC in micron sizes that can be used to increase the quality of low grade paper or paper board, especially that made from softwoods.

Further, commercial quality MCC, if texturized and transformed into suspension of particles of 5–30 microns, generally has a viscosity in the range of 20,000–200,000 cPs. Surprisingly, lower viscosity MCC produced by the present process also is more effective as a surface treatment for paper and paper board due to the nature of paper fibers and the filling nature of a low viscosity-submicron material.

SUMMARY OF THE INVENTION

An object of the invention is to provide a low cost texturized MCC for use in surface treatment of paper and paper board.

It is a further object of the invention to provide texturized MCC from starting materials with poor cellulosic content, e.g., paper grade southern pine and other chemical softwoods.

It is still a further object of the invention to provide a process of producing texturized MCC using readily available materials and equipment already employed at paper manufacturing facilities.

It is another object of the invention to provide a texturized MCC that is capable of replacing 5% to 100% of the fiber furnish of paper or paper board.

It is still another object of the invention to provide a texturized MCC that is capable of combining with dyes for use in coloring paper or paper board without the use of colored white water systems.

The present invention overcomes the drawbacks of the prior art through the novel development of a hydrolysis process that can be used on pulp material with a low cellulose content, such as southern pine and other soft woods. This in turn yields a low cost improved "texturized" MCC that is capable of enhancing the quality of low grade paper or paper board through its application as a surface treatment or its use as a starting material.

The texturized MCC of the present invention has a cellulose content ranging from about 85% to about 95% (versus the minimum 97% for commercial MCC), and contains substantial amounts of hemicellulose relative to commercial MCC.

Typical commercial MCC has a hemicellulose content ranging from about 2% to 4%, while the texturized MCC of the present invention has a hemicellulose content ranging from about 5% to about 15%. These residual components of the raw pulp material enhance the binding capacity of the texturized MCC, which in turn increases its ability to act as a surface treatment for paper and paper board.

Wood fibers used in paper production generally have a diameter of 15–30 microns and a length of 1000–3000 microns. The texturized MCC of the present invention has a low viscosity, high binding capacity and micron to submicron length, which is useful as a surface treatment because these qualities allow the texturized MCC to fill in to a greater extent the surface pores of rough paper. This is demonstrated in FIG. 1, which contains electron microscopy images of hardwood paper and softwood paper before and after coating with a layer of texturized MCC. These images reveal how well the micron to submicron size of the texturized microcrystalline cellulose particles of the present invention fill in the surface pores of rough paper and paper board, thereby increasing the smoothness of the finished product.

The result is a smooth cellulose film with high surface strength and good printability. This is an economical upgrade for many non-glossy grades, such as web offset based on uncoated free sheet, and cut size for copier or office multipurpose, or other cheap bulky sheets. A thin layer of texturized MCC also can be used as a pre-coat for the high quality coated paper or paperboard grades.

DETAILED DESCRIPTION OF THE INVENTION

The following detailed description illustrates an embodiment of the present invention, however, it is not intended to limit the scope of the appended claims in any manner whatsoever.

The process of producing the texturized MCC of the present invention in general comprises an acid hydrolysis step followed by a mechanical defibrillation step. In the acid hydrolysis step, the raw pulp material, preferably a softwood pulp feed, is contacted with an acid hydrolysis agent in an acid hydrolysis reactor at a temperature ranging from about 80° C. to about 120° C., and at an acid hydrolysis agent concentration ranging from about 1% to about 5%. Preferably the acid hydrolysis temperature ranges from about 90° C. to 110° C. and the acid hydrolysis agent concentration ranges from about 2% to about 3%. Typical pulp consistency in the acid hydrolysis reactor ranges from about 3% to about 50%, more preferably from about 10% to about 35%, and typical residence times range from about 30 minutes to about 4 hours; more preferably from about 60 minutes to about 2 hours.

The softwood pulp feed stock may be derived from softwoods such as southern pine fibers. Examples include, but are not limited to; conventional fully bleached kraft pulp, spruce, pine, cedar, western hemlock, fir or redwood. The pulp may be formed from any of the known kraft or soda pulping processes, such as, but not limited to kraft-AQ, kraft-PS-AQ, or soda-AQ pulping processes.

Figure 2:
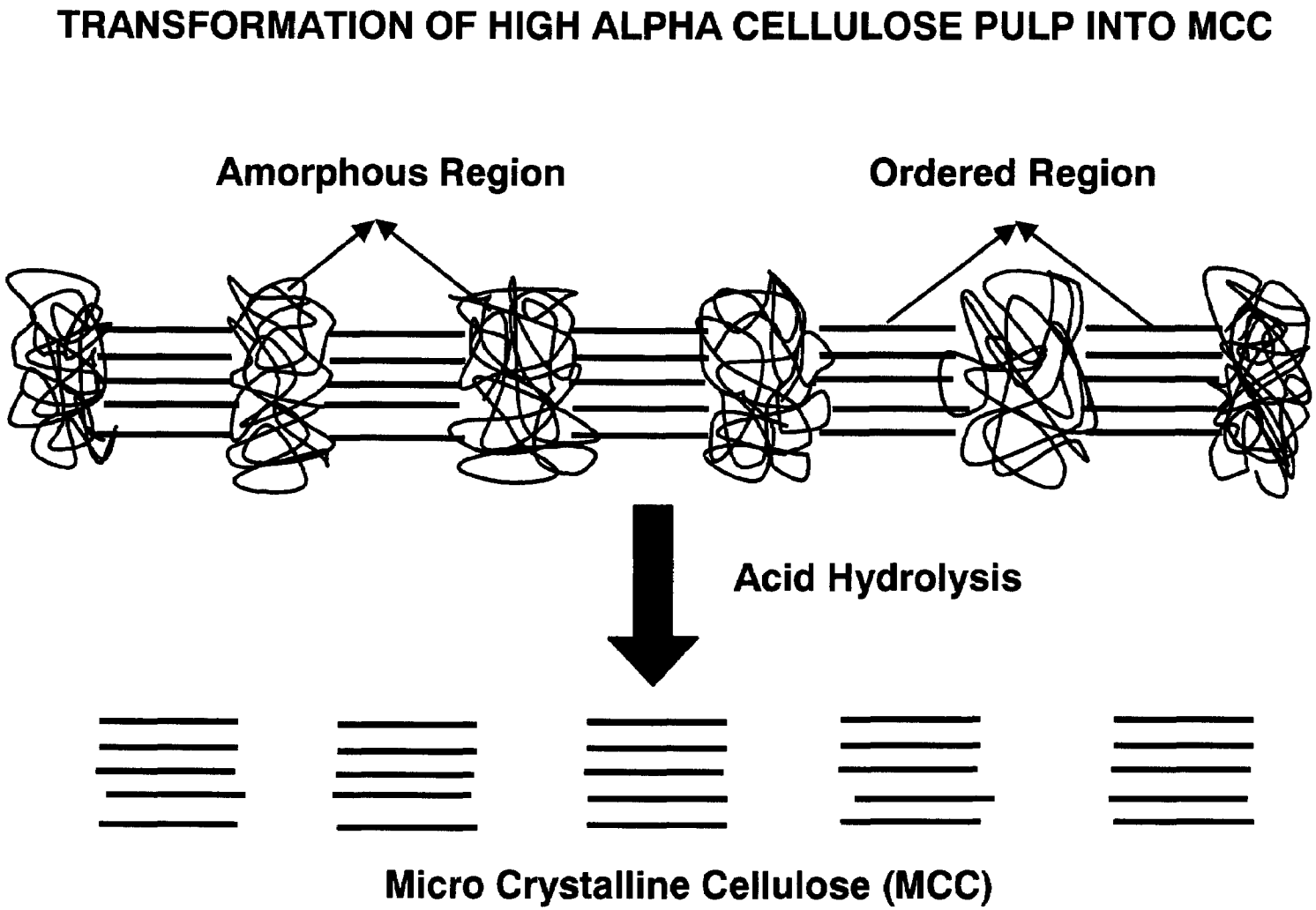
FIG. 2 is a representation of the transformation of high alpha cellulose pulp into microcrystalline cellulose.

The acid hydrolysis agent used may comprise any mineral acid, such as, but not limited to, hydrochloric acid (HCl), sulfuric acid ($H_2SO_4$), and/or nitric acid ($HNO_3$). The cellulosic material is hydrolyzed with an acid hydrolysis agent to dissolve the amorphous cellulose fraction. As can be seen in FIG. 2, raw cellulose consists of ordered regions and amorphous regions. The acid hydrolysis removes a large amount of the amorphous regions, thereby producing a microcrystalline cellulose paste. Commercial MCC products (formed via hydrolysis) use additional steps to refine further the cellulosic content of the microcrystalline cellulose paste whereby the hemicellulose content of the overall MCC paste is substantially eliminated. These additional steps significantly add to the expense of producing commercial MCC. In contrast, the present invention retains a significant percentage of hemicellulose, which unexpectedly enhances the binding quality of the texturized MCC, thereby increasing its use as a surface treatment for paper and paper board. The acid hydrolysis reaction step of the present invention produces microcrystalline cellulose having an intrinsic viscosity ranging from about 1.2 to about 1.8 dL/g range, which corresponds to a degree of polymerization (DOP) ranging from about 150 to about 200.

Moreover, in accordance with the present invention, once the raw pulp has been hydrolyzed, preferably, it is not dried. Commercial quality MCC is generally dried and washed with additional chemicals to remove impurities and excess acid. Such steps are avoided in accordance with the practice of the present invention.

The next step of the process of the present invention is mechanical disintegration. The MCC paste obtained from the acid hydrolysis step is placed directly in a machine with shearing, blending and/or masticating qualities, such as a Lab Warren Blender, to process the MCC paste until the microcrystalline cellulose particle size has been reduced to micron and submicron length. Preferably, the mechanical disintegration process step shears the crystalline cellulose particles to transform them into micron-size crystalline particle, i.e., ranging from about 1 micron to about 10 microns, as opposed to the up to 30 micron MCC particles of the prior art. Likewise, the mechanical disintegration process step of the present invention provides a final texturized MCC product having a viscosity ranging from about 500 to about 2000 cPs, which is significantly lower than the viscosity of commercial MCC that ranges from 20,000 to 200,000 cPs.

In preferred embodiments the mechanical disintegration process step is carried out in a commercial disk refiner for wood pulps, operated at a specific refining energy input ranging from about 5 kWh/ton to about 100 kWh/ton, more preferably from about 10 kWh/ton to 30 kWh/ton.

The texturized MCC produced from the above process may then be used as a surface treatment for paper or paper board, including printing paper surfaces and to coated board as base coat. The surface treatment may be carried out by various techniques known in the art such as roll coating and blade coating, metered size-press coating, rod coating, "shower" coating and curtain jet coating.

In one embodiment of the present invention surface treatments may be applied using a "shower" technique. In this process, 2-layer hand sheets are made on a standard TAPPI (Technical Association of the Pulp and Paper Industry) sheet mold, by first draining the bottom layer furnish to a thin water column level, and then applying a top layer of texturized MCC through a "shower" means such as one made with a perforated plastic cup to disperse the texturized MCC in a shower method. The combined furnish is then drained completely on the sheet mold.

Another method of surface coating is curtain jet coating on a forming wire similar to the method disclosed in Foulger et al., "Cost effective new technology to apply to starch and other additives," TAPPI 1999 proceedings, p.141. This can be used with one sided coated board grades. The hydrodynamic instability of the curtain jet usually requires low-speed operation, but, advantageously, this process has a low capital cost and eliminates additional drying costs. Additionally, other surface application strategies, such as even mini-headbox could be employed, depending on the available equipment to the paper machine and coating operators.

Texturized MCC forms a very smooth film with enhanced bonding, pigment binding capacity, stiffness and temperature resistance. It can be used as a carrier for dyes, full width arrays and sizing additives. When dyes are added to texturized MCC before paper surface treatment, the troublesome necessity of implementing white water systems is eliminated. This in turn expands the product capabilities of many paper machines that are not equipped to function with white water systems. Other additives or treatments to the texturized MCC of the present invention also are contemplated by the present invention. For example, treatments for imparting functions such as plasticization, polymer grafting, grease resistance by conventional methods are within the scope of the present invention. Additionally, fibril-based oxycellulose and fibril-based cationic retention aides and strength agents can be prepared in accordance with the present invention.

Additionally, due to the low cost of production, the texturized MCC may be used as the starting material for paper or paper board production.

DESCRIPTION OF THE PREFERRED EMBODIMENTS

The present invention will be further illustrated by a fully bleached southern pine kraft pulp.

EXAMPLE I

In a one embodiment of the present invention, surface treatments were applied using a "shower" technique. In this process 2-layer hand sheets are made on a standard TAPPI sheet mold, by first draining the bottom layer furnish to a thin water column level, and then applying a top layer of texturized MCC processed from bleached southern pine kraft pulp, prepared in accordance with the present invention. This is accomplished using a perforated plastic cup to disperse the texturized MCC in a shower method. The combined furnish is then drained completely on the sheet mold. Control sheets were made as single layer hand sheets. The pine furnish was refined to 540 csf (Canadian Standard Freeness) on a PFI mill. The hardwood furnish was refined to 450 csf. To avoid the bias caused by TAPPI hand sheet wet pressing, where the sheet side facing the metal plate usually gets more smoothing than the opposite side, the 2-stage TAPPI wet pressing procedure was modified slightly. The modification is as follows, after the first sheet pressing, the sheet was peeled off and its opposite side was put against the metal plate before the second stage pressing.

Figure 3:
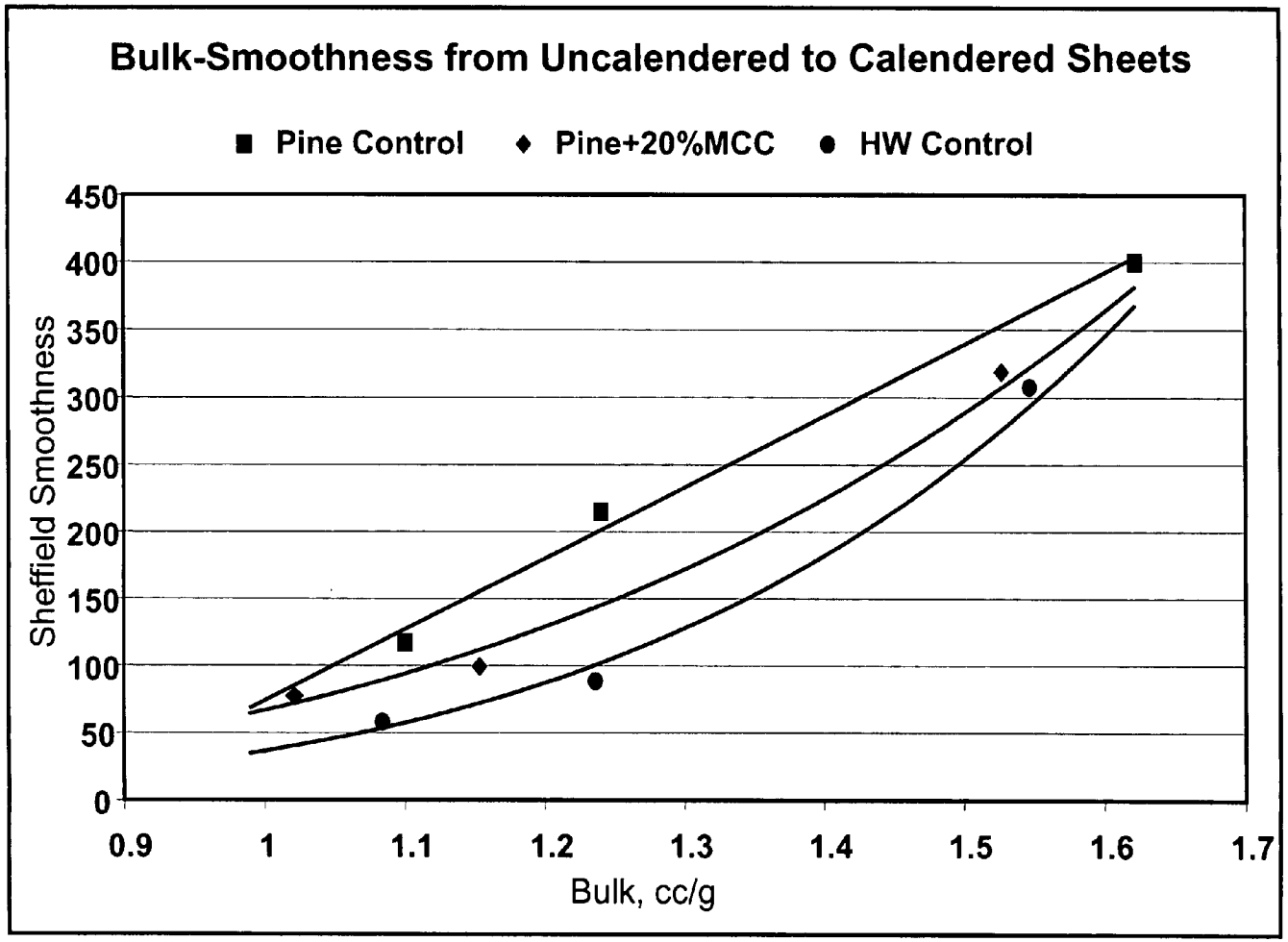
FIG. 3 is a bulk smoothness chart containing a hardwood control, a pine control and a pine with 20% texturized MCC.

The results, as set forth in Table 1 below, showed a pine control with a very rough surface both before and after calendering. However, once the pine sheet was covered with a top layer of texturized MCC the smoothness approached that of the hardwood. The bulk smoothness was also substantially improved as compared with the pine control sheets. (See FIG. 3).

EXAMPLE 2

A laboratory paper making machine called Dynamic Sheet Former (DSF) was used to simulate the commercial production of paperboard samples. Corresponding DSF sheets are surface treated with texturized MCC of the present invention on the top surface using a jet during DSF formation. Single layer pine sheets and hardwood sheets were also made as controls. The targeted OD basis weight was 200#/3000 sq ft. The fiber furnishes used were southern pine (Valley refined to 500 csf), mill-refined Hardwood (589 csf), and texturized MCC (made from southern pine) added to the DSF sheets.

The DSF sheets were prepared to contain 5% and 10% texturized MCC, with all the MCC applied as the top layer, together with the control pine and hardwood DSF sheets. All DSF were then calendered at identical conditions (i.e., 50 psi for DSF paper size). The Sheffield smoothness (a measure of the roughness of the paper board top sheet) for these papers were: 166.5 for hardwood control; 287 for 5% texturized MCC top layer; 225 for 10% texturized MCC top layer; and 363 for the pine control. For all the uncalendered DSF sheets the Sheffield rating is 478 (highest instrument reading).

Figure 1:
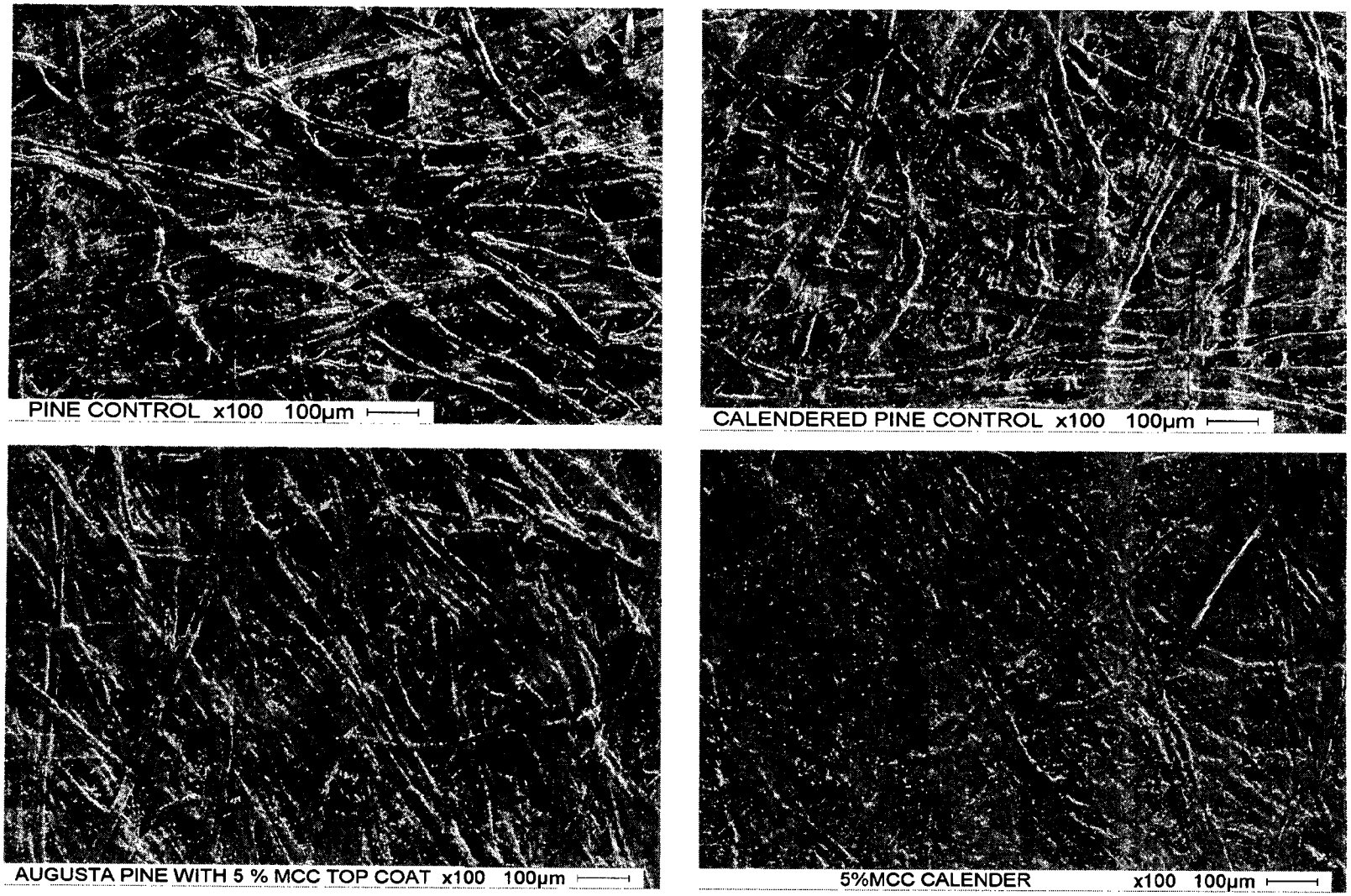
FIG. 1 contains electron microscopy images of hard wood paper and softwood paper before and after a 20% addition of texturized MCC.
Figure 4:
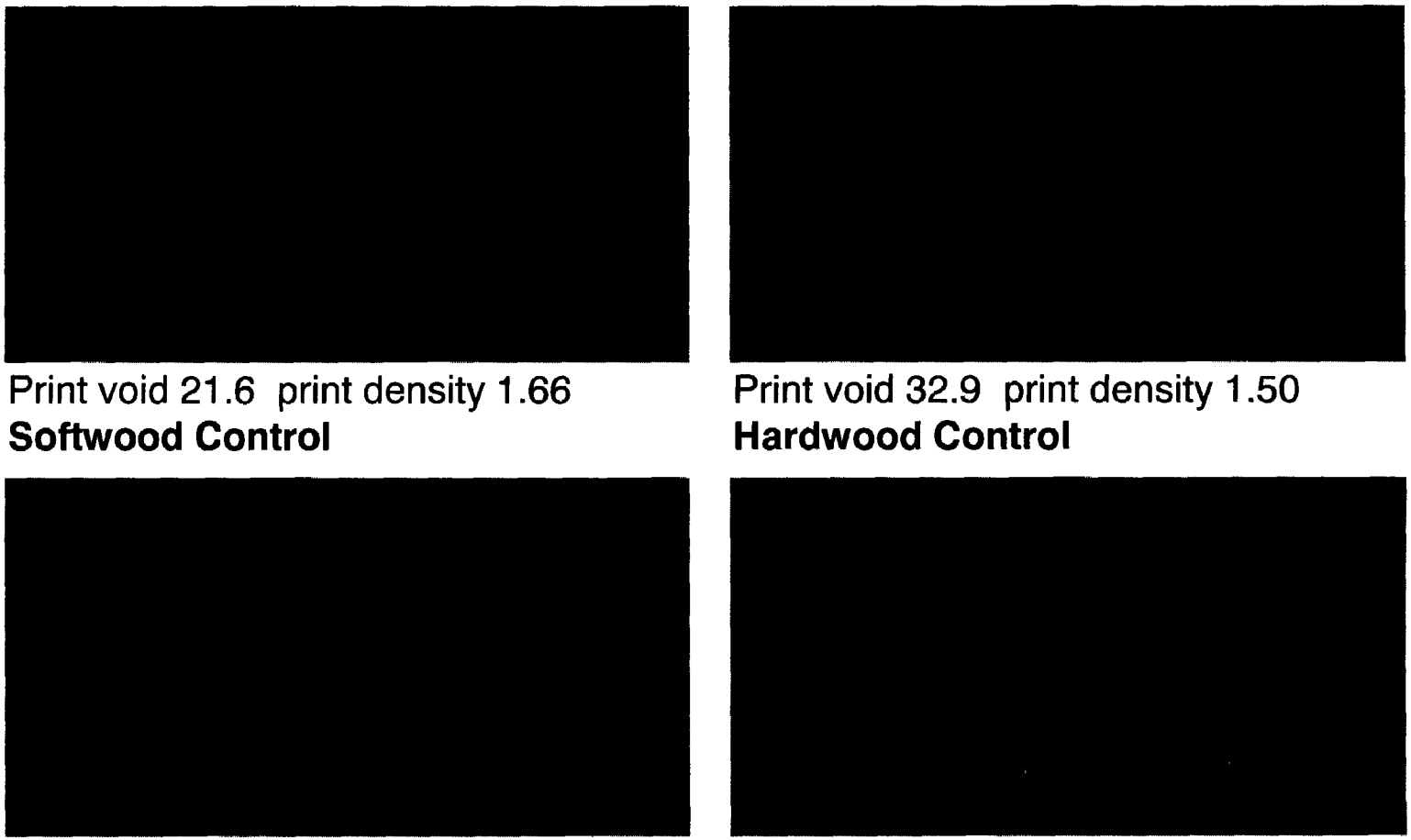
FIG. 4 shows images of printed surface for control paper and paper products with coatings of the present invention.
Figure 5:
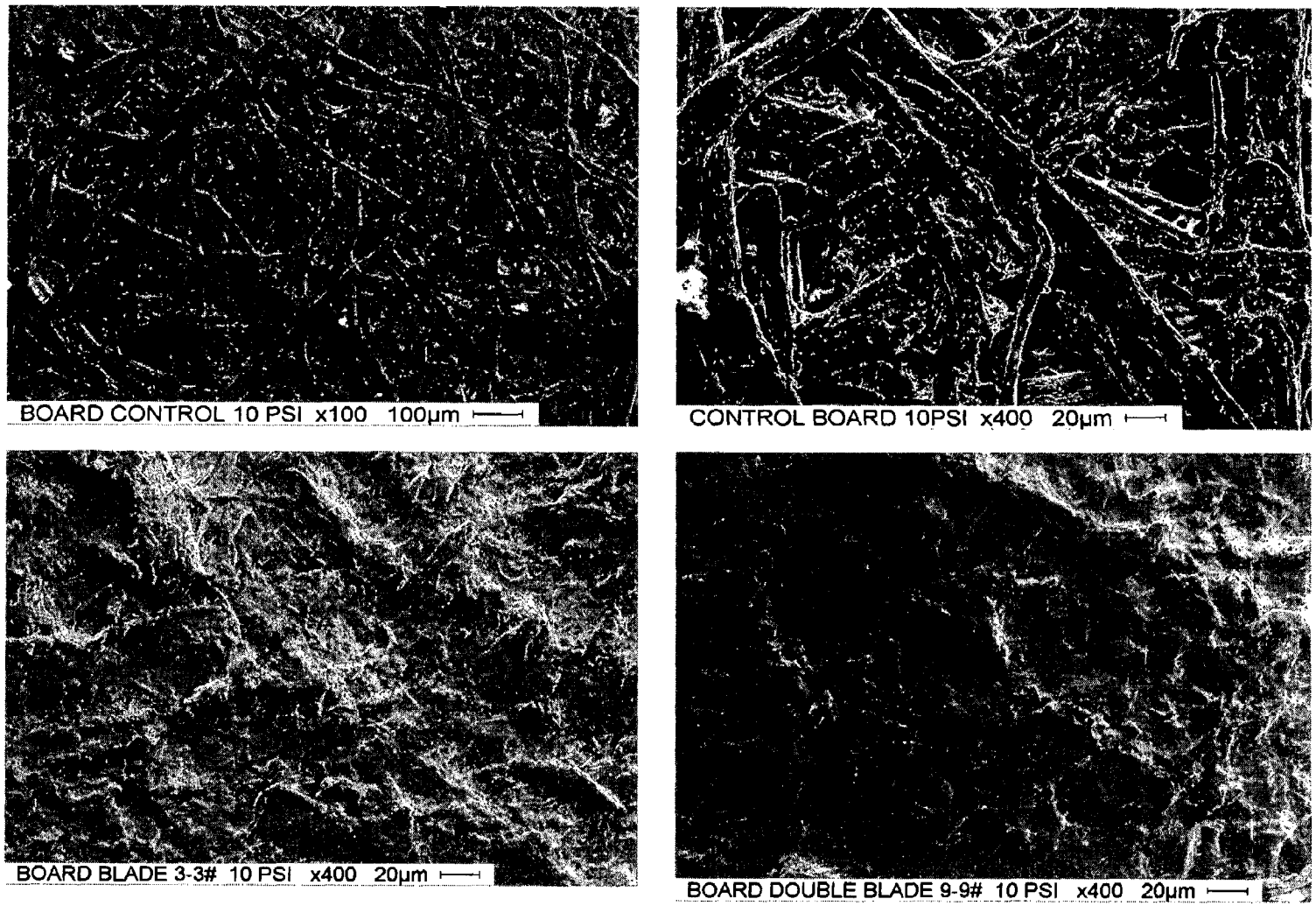
FIG. 5 shows electron microscopy images of a commercial paperboard sample before and after coated with 3.3 lbs and 9.9 lbs of texturized MCC per 3000 $ft^2$ of paper surface.

The Sheffield smoothness in this case did not completely reflect the enhanced smoothness of the texturized MCC treated DSF sheets. Electron microscopy images (as seen in FIG. 1) of the above sample surfaces revealed that the surface pores were filled and smoothed by the texturized MCC, resulting in a unique and closed surface film even closer to the hardwood control than the Sheffield tests revealed. Prufbau offset printing tests of these surfaces, as seen in FIG. 4, indicated substantially improved ink coverage and significantly superior print density due to the MCC surface treatment of the present invention.

EXAMPLE 3

A lab scale puddle size-press was used to apply texturized MCC on the surface of a Springhill uncoated free sheet (UFS envelope grade). The texturized MCC was applied at a solids content of 5%, and a starch control was made at 6% solids. After very light calendering at identical conditions, the sheets (8" by 11") were printed at a flexo proofer to determine the flexo printability. The results indicate that the ink coverage or print uniformity of the MCC sized sample was better than the starch control.

TABLE 1

| 4" × 4" Square | Pine Control | | | Pine + 20% MCC | | | HW Control | | | HW + 20% MCC | | |
|---|---|---|---|---|---|---|---|---|---|---|---|---|
| Calendered at | 0 psi | 20 psi | 40 psi | 0 psi | 20 psi | 40 psi | 0 psi | 20 psi | 40 psi | 0 psi | 20 psi | 40 psi |
| Basis Wt., gms. | 107 | 108 | 109 | 104 | 101 | 102 | 109 | 108 | 106 | 106 | 110 | 106 |
| Caliper, mils. | 6.83 | 5.28 | 4.70 | 6.26 | 4.6 | 4.11 | 6.64 | 5.32 | 4.55 | 6.0 | 4.94 | 4.17 |
| Bulk, cc/g | 1.622 | 1.24 | 1.096 | 1.527 | 1.153 | 1.019 | 1.547 | 1.236 | 1.084 | 1.434 | 1.144 | 0.989 |
| Sheffield | | | | | | | | | | | | |
| MCC side | 400 | 215 | 117 | 319 | 99 | 78 | 308 | 89 | 58 | 225 | 86 | 48 |
| Non-MCC side | | | | 401 | | | | | | 348 | | |
| Dension | 17 | 16 | 18 | 13 | 16 | 18 | 14 | 14 | 13 | 13 | 13 | 13 |
| Wax Pick # | | | | | | | | | | | | |
| Tensile, lbs/in | 36 | | | 34.6 | | | 29.4 | | | 28.2 | | |
| Tear, gms | 173 | | | 134 | | | 82.9 | | | 72.0 | | |
| Mullen C, Lbs/sq in. | 91 | | | 76 | | | 57 | | | 52 | | |

EXAMPLE 4

A high speed laboratory coater was used to apply texturized MCC onto the surface of a commercial 14 pt fully bleach paperboard sample. The texturized MCC was applied at a solids content of 10%. The size press was run at 1400 FPM when installed with a blade; and at 1000 PFM when installed with rod. A single pass of the paper sample through the blade resulted in a pick-up of 3.6 lbs of dry MCC material per 3000 $ft^2$ of the paper surface. A second pass of the paper increased the MCC pick-up to 9.9 lbs/3000 $ft^2$. A single pass through the rod provided a MCC pick-up of 3.45 lbs/3000 $ft^2$.

EXAMPLE 5

A standard lab flexo print test was used to quantify the impact of MCC coating on print quality of the above 14 pt board sample and the same samples after MCC coating. On the control 14 pt board samples, the print test showed a print void value of 20.5 and a print density of 1.4. On the board sample coated with 3.6 lbs/3000 ft, the same print test showed values of 13.5 for print void and 1.6 for print density. On the board sample coated with 9.9 lbs/3000 $ft^2$, the same print test showed values of 11 for print void and 1.68 for print density. Low print void numbers and high print density numbers would predict a better and more uniform print quality of the associated paper sample.

Variations, modifications and alterations to the above detailed description will be apparent to those skilled in the art in reviewing the present specification. All such variations, and modifications and alternatives are intended to fall within the scope of the present claimed invention. All of the above mentioned patents and publications are incorporated by reference in their entirety.

We claim:

1. A process for producing a texturized microcrystalline cellulose for use in a paper or paper board coating composition, said process comprising the steps of:

(a) hydrolyzing a cellulosic material with a mineral acid to provide a crystalline intermediate having an intrinsic viscosity ranging from about 1.2 to about 1.8 dL/g and a degree of polymerization ranging from about 150 to about 200, said intermediate also comprising a significant amount of hemicelluloses; and (b) mechanically defibrillating said intermediate to produce texturized microcrystalline cellulose particles of micron and sub-micron size.

2. The process according to claim 1, wherein said cellulosic material is derived from a pulp material selected from the group consisting of kraft pulp, spruce, pine, cedar, western hemlock, fir, redwood or other softwoods.

3. The process according to claim 2, wherein said pulp material comprises a southern pine pulp.

4. The process according to claim 2, wherein the pulp material comprises a southern pine Kraft pulp.

5. The process according to claim 2, wherein said pulp material comprises a conventional fully bleached kraft pulp and sulphite pulp.

6. The process according to claim 1, wherein said acid hydrolysis step occurs at a temperature ranging from about 90° C. to about 120° C., and at an acid hydrolysis agent concentration ranging from about 2% to about 4%.

7. The process according to claim 1, wherein the pulp consistency ranges from about 5% to about 40%.

8. The process according to claim 1, wherein said residence time of the acid hydrolysis step ranges from about 30 minutes to about 2 hours.

9. The process according to claim 1, wherein said mechanical disintegration process step is carried out in commercial pulp refiner equipment, operated with a specific refining energy ranging from about 10 kWh/ton to about 100 kWh/ton.

10. The process according to claim 1, wherein the hemicelluloses content of microcrystalline cellulose ranges from about 5% to about 15% by weight.

11. A process for producing a paper or paper board having a texturized microcrystalline cellulose coating composition, said process comprising the steps of:

(a) hydrolyzing a cellulosic material with a mineral acid to provide a crystalline intermediate having an intrinsic viscosity ranging from about 1.2 to about 1.8 dL/g and a degree of polymerization ranging from about 150 to about 200, said intermediate also comprising a significant amount of hemicelluloses;

(b) mechanically defibrillating said intermediate to produce texturized microcrystalline cellulose particles of micron and sub-micron size.

(c) coating of the paper or paper board product with said texturized microcrystalline cellulose particles.

12. The process according to claim 11, wherein said coating step comprises a coating technique selected from the group consisting of roll coating, blade coating, metered size-press coating, rod coating, "shower" coating, curtain jet coating or surface layer forming by mini-headbox on paper machine.

13. The process according to claim 12, wherein said coat step comprises roll coating and/or blade coating.

14. The process according to claim 12, wherein said coating process is spray coating.

15. The process according to claim 12, wherein said coating process is curtain coating.

16. The process according to claim 11, wherein said coating step comprises coating said paper or paper board with an amount of said texturized microcrystalline cellulose particles ranging from about 2 lbs to about 10 lbs of the dry MCC material per 3000 $ft^2$ of the paper or board surface.

17. The process according to claim 16, wherein said coating formulation comprises between 5–20% texturized microcrystalline solids.

18. The process according to claim 11, wherein said paper or paper board is calendered.

19. The process according to claim 11, wherein the pulp consistency in the acid hydrolysis step ranges from about 8% to about 45%, and the residence time range from about 30 minutes to about 2 hours.

20. The process according to claim 11, wherein said mechanical disintegration process step is carried out in commercial pulp refining equipment, operated with a specific refining energy ranging from about 10 kWh/ton to about 100 kWh/ton.

21. The process according to claim 11, wherein the hemicelluloses content of microcrystalline cellulose ranges from about 5% to about 15% by weight.

22. The paper or paper board product produced by the process comprising:

(a) hydrolyzing a cellulosic material with a mineral acid to provide a crystalline intermediate having an intrinsic viscosity ranging from about 1.2 to about 1.8 dL/g and a degree of polymerization ranging from about 150 to about 200, said intermediate also comprising a significant amount of hemicelluloses; and (b) mechanically defibrillating said intermediate to produce texturized microcrystalline cellulose particles of micron and sub-micron size.

(c) coating of the paper or paper board product with said texturized microcrystalline cellulose particles.

23. The process according to claim 22, wherein the hemicelluloses content of microcrystalline cellulose ranges from about 5% to about 15% by weight.

* * * * *